US010595689B1

(12) United States Patent
House et al.

(10) Patent No.: US 10,595,689 B1
(45) Date of Patent: Mar. 24, 2020

(54) WINDOW CLEANING KIT

(71) Applicants: Hughie House, Montgomery, TX (US); Alfiya House, Montgomery, TX (US)

(72) Inventors: Hughie House, Montgomery, TX (US); Alfiya House, Montgomery, TX (US)

( * ) Notice: Subject to any disclaimer, the term of this patent is extended or adjusted under 35 U.S.C. 154(b) by 0 days.

(21) Appl. No.: 16/155,367

(22) Filed: Oct. 9, 2018

(51) Int. Cl.

| | |
|---|---|
| ***A47L 1/08*** | (2006.01) |
| ***A46B 11/06*** | (2006.01) |
| ***B08B 1/00*** | (2006.01) |
| ***A46B 17/06*** | (2006.01) |
| ***B08B 3/02*** | (2006.01) |
| ***B65D 25/32*** | (2006.01) |
| ***B08B 3/04*** | (2006.01) |

(52) U.S. Cl.
CPC ..... *A47L 1/08* (2013.01); *A46B 11/06* (2013.01); *A46B 17/06* (2013.01); *B08B 1/002* (2013.01); *B08B 3/026* (2013.01); *B08B 3/04* (2013.01); *B65D 25/32* (2013.01); *A46B 2200/30* (2013.01)

(58) Field of Classification Search
CPC ..... A46B 11/06; A46B 17/06; A46B 2200/30; A47L 1/06; A47L 1/08; A47L 7/00; B08B 1/002; B08B 3/026; B08B 3/04; B65D 25/32
See application file for complete search history.

(56) References Cited

U.S. PATENT DOCUMENTS

| | | | | |
|---|---|---|---|---|
| 2,746,071 A | | 5/1956 | Charun | |
| 3,600,740 A | | 8/1971 | Ogler | |
| 4,778,298 A | | 10/1988 | Shin | |
| 4,887,713 A | * | 12/1989 | Tupper | A47L 1/06 206/225 |
| 5,271,682 A | | 12/1993 | Realdon | |
| 5,799,362 A | * | 9/1998 | Huffman | A47L 1/08 15/321 |
| 5,887,314 A | | 3/1999 | Jordan, Jr. | |
| 5,909,832 A | * | 6/1999 | French | A47L 13/51 206/223 |
| 6,135,276 A | * | 10/2000 | French | A47L 13/51 206/225 |
| 7,874,757 B2 | | 1/2011 | Bruggeman | |
| 8,677,549 B2 | * | 3/2014 | Fields | A47L 1/06 15/245 |
| 8,926,210 B2 | | 1/2015 | Orubor | |
| 2008/0109975 A1 | * | 5/2008 | Park | A47L 1/08 15/105 |
| 2009/0211607 A1 | * | 8/2009 | Garland | A47L 1/08 134/21 |

FOREIGN PATENT DOCUMENTS

| | | | | |
|---|---|---|---|---|
| CN | 202311928 U | * | 7/2012 | |
| GB | 2502643 A | * | 12/2013 | A47L 1/08 |

* cited by examiner

*Primary Examiner* — Bryon P Gehman

(57) ABSTRACT

A window cleaning kit for cleaning elevated windows includes a pole, which is tubular, and a pump module. The pump module comprises a reservoir that is configured to position a respective solution. A hose is selectively couplable to a lower end of the pole and the pump module and is positioned to fluidically couple the pole to the reservoir. A scrubber and a spray head are selectively couplable to an upper end of the pole. The pump module is configured to selectively pump the respective fluid positioned in the reservoir through the hose and the pole to the scrubber and the spray head. The scrubber is configured to scrub a window and the spray head is configured to spray the window.

11 Claims, 5 Drawing Sheets

WINDOW CLEANING KIT

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relate to cleaning kits and more particularly pertains to a new cleaning kit for cleaning elevated windows.

BRIEF SUMMARY OF THE INVENTION

An embodiment of the disclosure meets the needs presented above by generally comprising a pole, which is tubular, and a pump module. The pump module comprises a reservoir that is configured to position a respective solution. A hose is selectively couplable to a lower end of the pole and the pump module and is positioned to fluidically couple the pole to the reservoir. A scrubber and a spray head are selectively couplable to an upper end of the pole. The pump module is configured to selectively pump the respective fluid positioned in the reservoir through the hose and the pole to the scrubber and the spray head. The scrubber is configured to scrub a window and the spray head is configured to spray the window.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
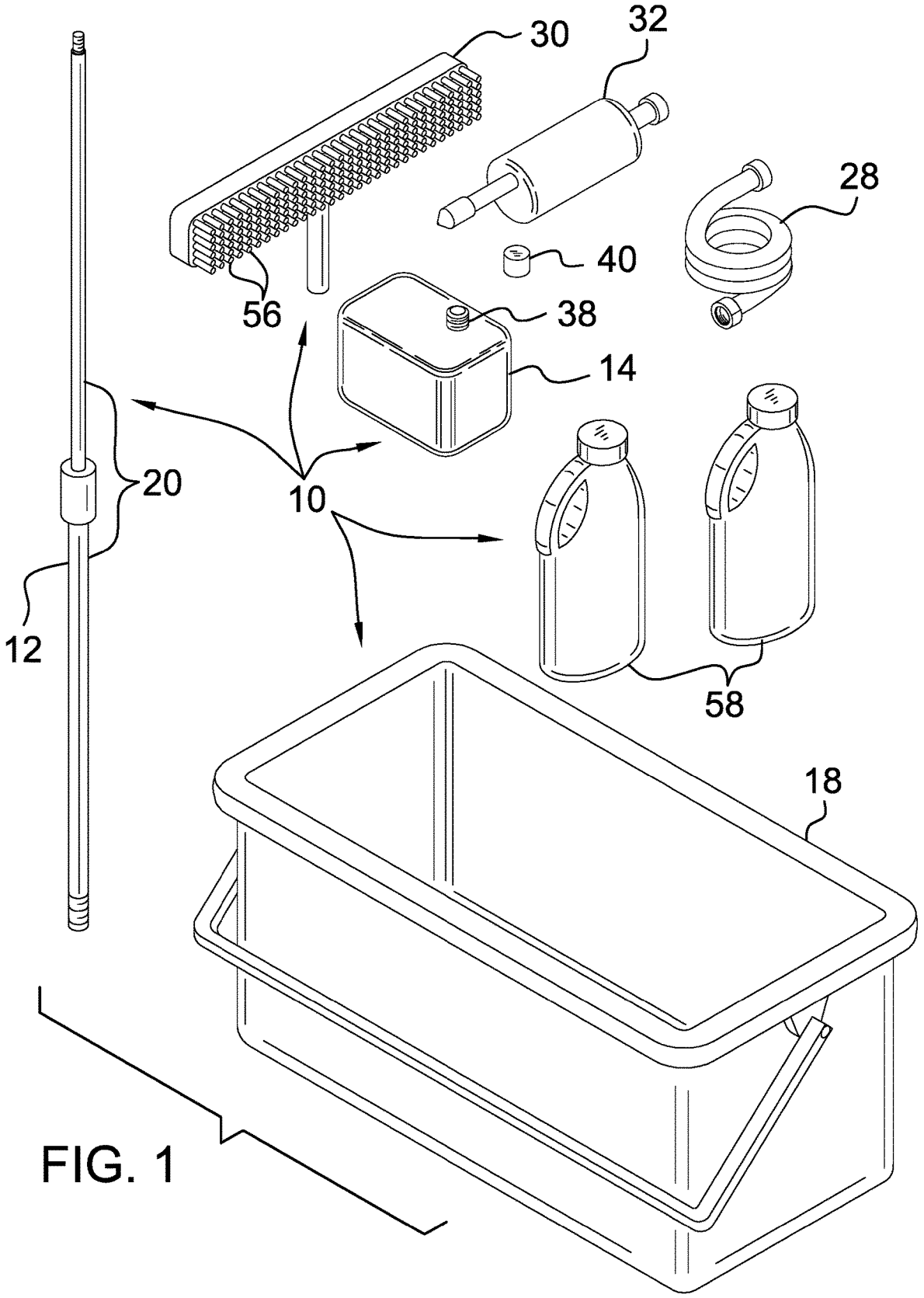
FIG. 1 is an isometric perspective view of a window cleaning kit according to an embodiment of the disclosure.

With reference now to the drawings, and in particular to FIGS. 1 through 5 thereof, a new cleaning kit embodying the principles and concepts of an embodiment of the disclosure and generally designated by the reference numeral 10 will be described.

Figure 2:
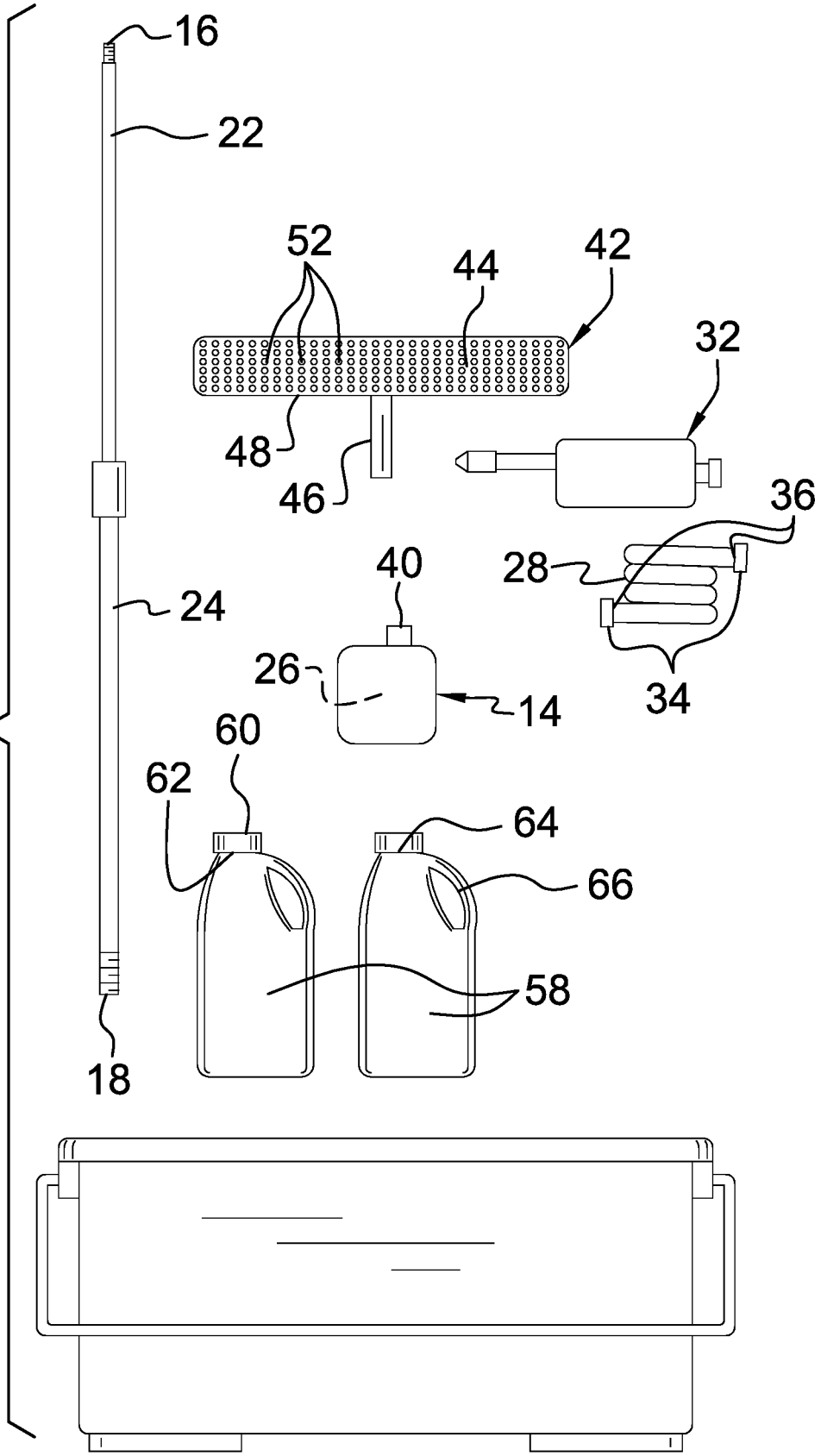
FIG. 2 is a front view of an embodiment of the disclosure.
Figure 3:
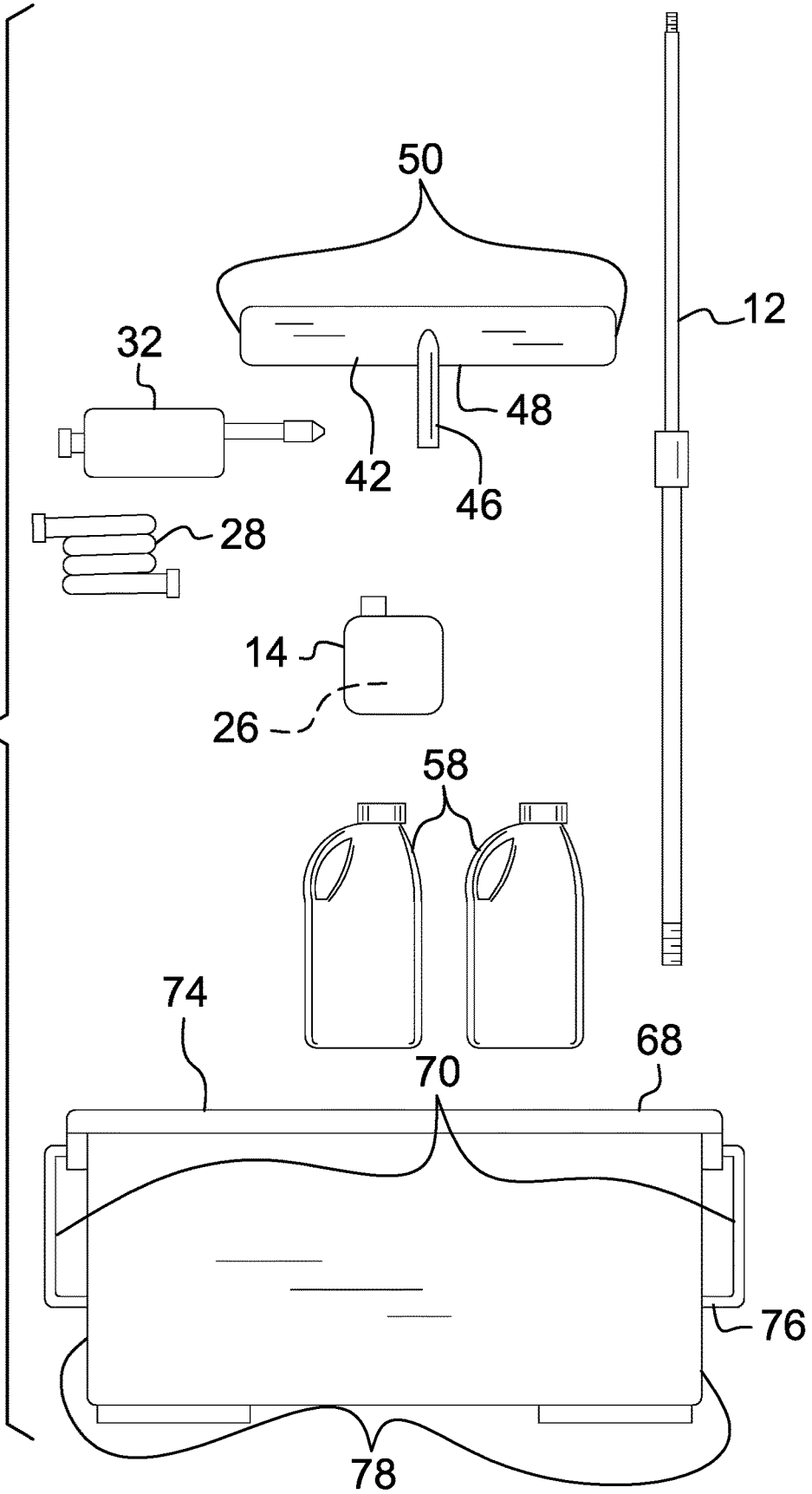
FIG. 3 is a rear view of an embodiment of the disclosure.
Figure 4:
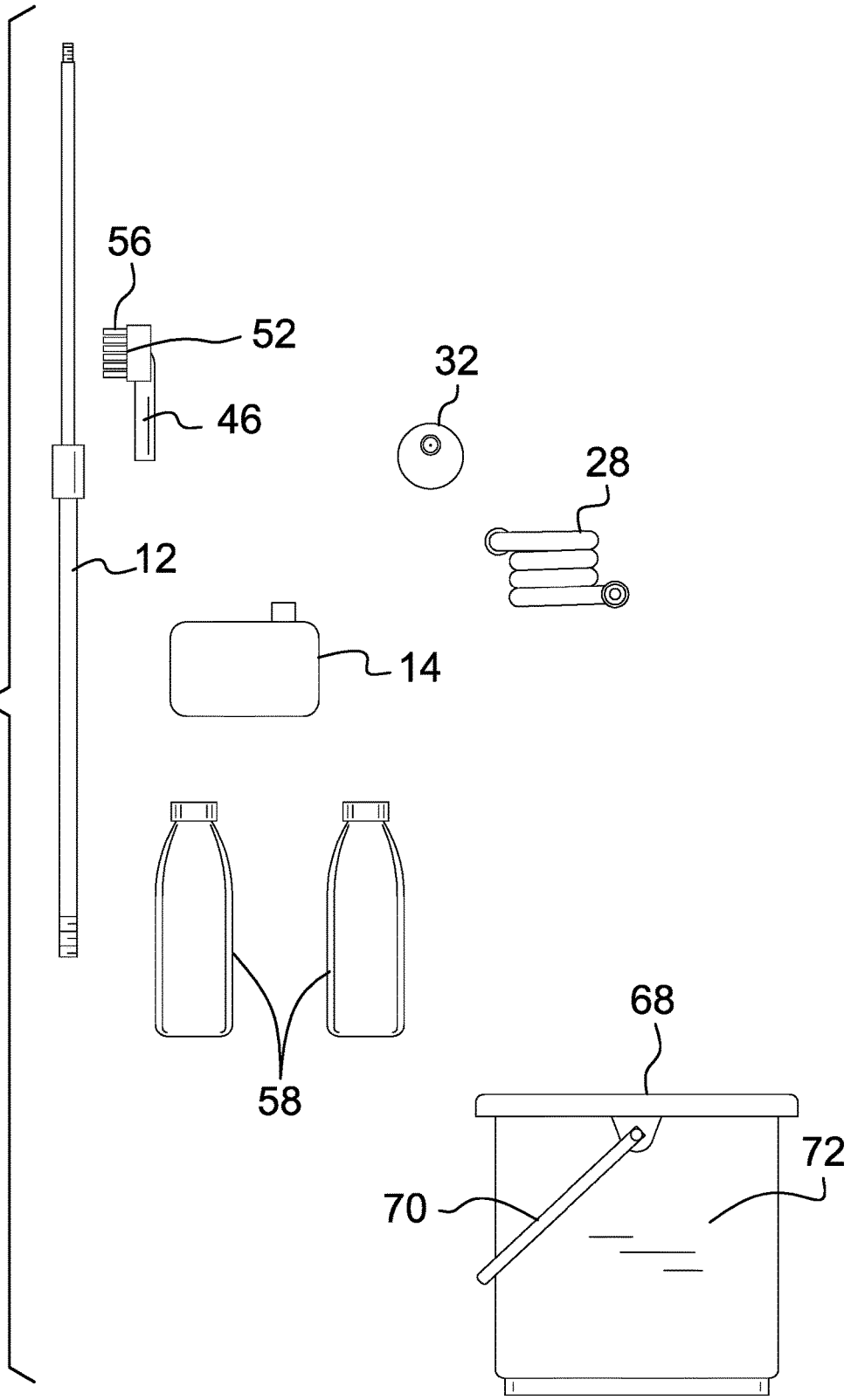
FIG. 4 is a side view of an embodiment of the disclosure.

As best illustrated in FIGS. 1 through 5, the window cleaning kit 10 generally comprises a pole 12, which is tubular, and a pump module 14. The pole 12 is externally threaded adjacent to an upper end 16 and a lower end 18 of the pole 12. The pole 12 comprises a plurality of nested sections 20 so that the pole 12 is selectively extensible. The plurality of nested sections 20 comprises an upper section 22 and a lower section 24, as shown in FIG. 2.

The pump module 14 comprises a reservoir 26 that is configured to position a respective solution, such as a soap solution and water. A hose 28 is selectively couplable to a lower end 18 of the pole 12 and the pump module 14 and is positioned to fluidically couple the pole 12 to the reservoir 26. A scrubber 30 and a spray head 32 are selectively couplable to an upper end 16 of the pole 12. The pump module 14 is configured to selectively pump the respective fluid that is positioned in the reservoir 26 through the hose 28 and the pole 12 to the scrubber 30 and the spray head 32. The scrubber 30 is configured to scrub a window and the spray head 32 is configured to spray the window.

A pair of female hose couplers 34 is coupled singly to opposing endpoints 36 of the hose 28. The female hose couplers 34 are complementary to the lower end 18 of the pole 12 and a pipe 38 that is coupled to and extends from the pump module 14. Each female hose coupler 34 is positioned to selectively couple to one of the lower end 18 of the pole 12 and the pipe 38 to fluidically couple the pole 12 to the reservoir 26. A cap 40, which is complementary to the pipe 38, is positioned to selectively couple to the pipe 38 to close the pipe 38.

The scrubber 30 comprises a housing 42 that defines an interior space 44. A tube 46 is coupled to and extends from a bottom 48 of the housing 42. The tube 46 is positioned equally distant from opposing ends 50 of the housing 42. The tube 46 is internally threaded distal from the housing 42 so that the tube 46 is positioned to threadedly couple to the upper end 16 of the pole 12 to fluidically couple the pole 12 to the interior space 44.

A plurality of holes 52 is positioned in a face 54 of the housing 42. A plurality of bristles 56 is coupled to and extends from the face 54 of the housing 42. The pump module 14 is configured to pump the respective fluid that is positioned in the reservoir 26 through the hose 28 and the pole 12 to the housing 42, where the respective fluid exits the holes 52 onto the bristles 56 and the window. The housing 42 is motivated across the window by the user moving the pole 12 so that the bristles 56 scrub the window to remove debris.

The kit 10 also comprises a plurality of containers 58. Each container 58 is configured to store a respective fluid. Each container 58 has a lid 60 that positioned to selectively close an opening 62 that is positioned in a top 64 of the container 58. Each container 58 comprises a handle 66 that is configured to be grasped in a hand of a user to lift the container 58. The plurality of containers 58 comprises two containers 58, as shown in FIG. 2.

Figure 5:
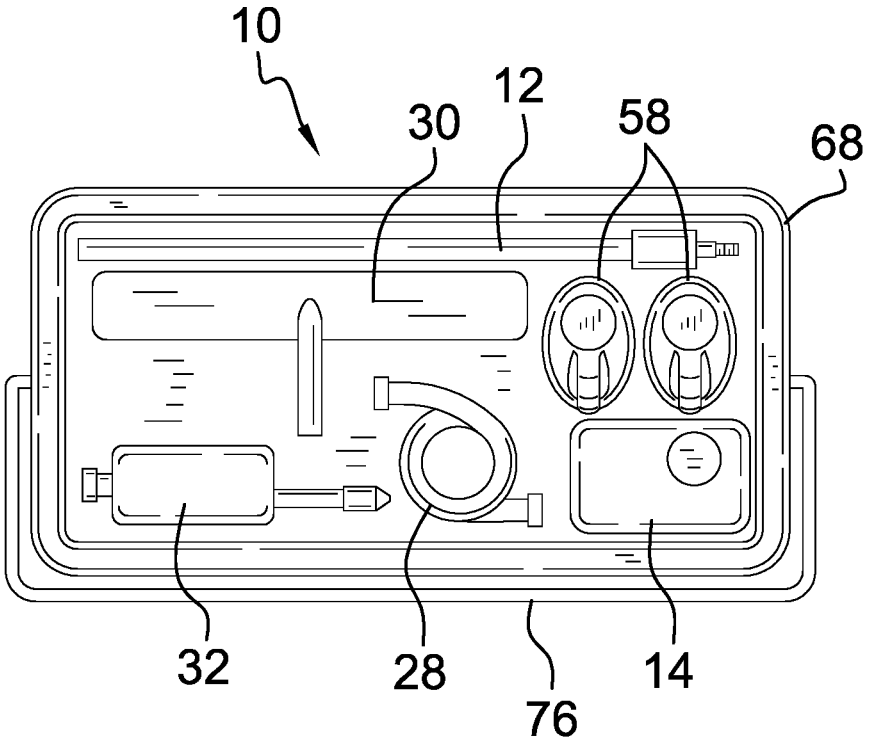
FIG. 5 is a top view of an embodiment of the disclosure.

The kit 10 also comprises a bucket 68 that is positioned to stow the pole 12, the pump module 14, the hose 28, the scrubber 30, the spray head 32, and the plurality of containers 58, as shown in FIG. 5. The bucket 68 is substantially rectangularly box shaped.

Each of a pair of first bars 70 is pivotally coupled to a respective opposing side face 72 of the bucket 68 proximate to an upper face 74 of the bucket 68. A second bar 76 is coupled to and extends between the first bars 70 distal from the bucket 68. The second bar 76 is configured to be grasped in the hand of the user to lift the bucket 68.

In a typical example of use, the reservoir 26 is filled with the soap solution from a respective container 58. The spray head 32 is coupled to the pole 12, positioning the pump module 14 to pump the soap solution through the spray head 32 onto the window. The pole 12 can be extended so that the spray head 32 reaches an elevated window. The scrubber 30 then is attached to the pole 12 and is used to scrub the window. Additional soap solution may be applied to the window during scrubbing. The spray head 32 is again coupled to the pole 12. Water, preferably deionized or distilled, is added to the reservoir 26 from a respective container 58, positioning the pump module 14 to pump the water through the spray head 32 to rinse the window. Alternatively, the initial application of the soap solution may be through the scrubber 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

We claim:

1. A window cleaning kit comprising:

a pole, the pole being tubular;

a pump module comprising a reservoir wherein the reservoir is configured for positioning a respective fluid;

a hose selectively couplable to a lower end of the pole and the pump module wherein the hose is positioned for fluidically coupling the pole to the reservoir;

a scrubber selectively couplable to an upper end of the pole wherein the pump module is configured for pumping the respective fluid positioned in the reservoir through the hose and the pole to the scrubber configuring the scrubber for scrubbing a window;

a spray head selectively couplable to the upper end of the pole wherein the pump module is configured for pumping the respective fluid positioned in the reservoir through the hose and the pole to the spray head such that the spray head is configured for spraying the window;

a plurality of containers, each container being configured for storing the respective fluid;

a bucket positioned for stowing the pole, the pump module, the hose, the scrubber, the spray head, and the plurality of containers, the bucket being substantially rectangularly box shaped;

a pair of first bars, each first bar being pivotally coupled to a respective opposing side face of the bucket proximate to an upper face of the bucket; and a second bar coupled to and extending between the first bars distal from the bucket wherein the second bar is configured for grasping in a hand of a user for lifting the bucket.

2. The kit of claim 1, further including the pole being externally threaded adjacent to the upper end and the lower end.

3. The kit of claim 1, further including the pole comprising a plurality of nested sections such that the pole is selectively extensible.

4. The kit of claim 3, further including the plurality of nested sections comprising an upper section and a lower section.

5. The kit of claim 2, further including a pair of female hose couplers coupled singly to opposing endpoints of the hose, the female hose couplers being complementary to the lower end of the pole and a pipe coupled to and extending from the pump module wherein each female hose coupler is positioned for selectively coupling to one of the lower end of the pole and the pipe for fluidically coupling the pole to the reservoir.

6. The kit of claim 5, further including a cap complementary to the pipe wherein the cap is positioned for selectively coupling to the pipe for closing the pipe.

7. The kit of claim 2, further including the scrubber comprising:

a housing defining an interior space;

a tube coupled to and extending from a bottom of the housing, the tube being positioned equally distant from opposing ends of the housing, the tube being internally threaded distal from the housing such that the tube is positioned for threadedly coupling to the upper end of the pole for fluidically coupling the pole to the interior space;

a plurality of holes positioned in a face of the housing; and a plurality of bristles coupled to and extending from the face of the housing.

8. The kit of claim 1, further including each container having a lid positioned for selectively closing an opening positioned in a top of the container.

9. The kit of claim 1, further including each container comprising a handle wherein the handle is configured for grasping in a hand of a user for lifting the container.

10. The kit of claim 1, further including the plurality of containers comprising two containers.

11. A window cleaning kit comprising:

a pole, the pole being tubular, the pole having an upper end and a lower end, the pole being externally threaded adjacent to the upper end and the lower end, the pole comprising a plurality of nested sections such that the pole is selectively extensible, the plurality of nested sections comprising an upper section and a lower section;

a pump module comprising a reservoir wherein the reservoir is configured for positioning a respective fluid;

a hose selectively couplable to the lower end of the pole and the pump module wherein the hose is positioned for fluidically coupling the pole to the reservoir;

a pair of female hose couplers coupled singly to opposing endpoints of the hose, the female hose couplers being complementary to the lower end of the pole and a pipe coupled to and extending from the pump module wherein each female hose coupler is positioned for selectively coupling to one of the lower end of the pole and the pipe for fluidically coupling the pole to the reservoir;

a cap complementary to the pipe wherein the cap is positioned for selectively coupling to the pipe for closing the pipe;

a scrubber selectively couplable to the upper end of the pole wherein the pump module is configured for pumping the respective fluid positioned in the reservoir through the hose and the pole to the scrubber configuring the scrubber for scrubbing a window, the scrubber comprising:

a housing defining an interior space, a tube coupled to and extending from a bottom of the housing, the tube being positioned equally distant from opposing ends of the housing, the tube being internally threaded distal from the housing such that the tube is positioned for threadedly coupling to the upper end of the pole for fluidically coupling the pole to the interior space, a plurality of holes positioned in a face of the housing, and a plurality of bristles coupled to and extending from the face of the housing;

a spray head selectively couplable to the upper end of the pole wherein the pump module is configured for pumping the respective fluid positioned in the reservoir through the hose and the pole to the spray head such that the spray head is configured for spraying the window;

a plurality of containers, each container being configured for storing a respective fluid, each container having a lid positioned for selectively closing an opening positioned in a top of the container, each container comprising a handle wherein the handle is configured for grasping in a hand of a user for lifting the container, the plurality of containers comprising two containers;

a bucket positioned for stowing the pole, the pump module, the hose, the scrubber, the spray head, and the plurality of containers, the bucket being substantially rectangularly box shaped;

a pair of first bars, each first bar being pivotally coupled to a respective opposing side face of the bucket proximate to an upper face of the bucket; and a second bar coupled to and extending between the first bars distal from the bucket wherein the second bar is configured for grasping in the hand of the user for lifting the bucket.

* * * * *